US007513441B2

(12) United States Patent
Rodriguez-Amaya et al.

(10) Patent No.: US 7,513,441 B2
(45) Date of Patent: Apr. 7, 2009

(54) VALVE FOR CONTROLLING A CONNECTION IN A HIGH-PRESSURE FUEL INJECTION APPARATUS FOR AN INTERNAL COMBUSTION ENGINE

(75) Inventors: Nestor Rodriguez-Amaya, Stuttgart (DE); Christoph Hollmann, Ludwigsburg (DE); Michael Mennicken, Wimsheim (DE); Matthias Beck, Stuttgart (DE); Hubert Greif, Markgroeningen (DE); Falk-Alexander Petry, Stuttgart (DE); Thilo Rzymann, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 474 days.

(21) Appl. No.: 10/572,567

(22) PCT Filed: Aug. 4, 2004

(86) PCT No.: PCT/DE2004/001744

§ 371 (c)(1),
(2), (4) Date: Mar. 17, 2006

(87) PCT Pub. No.: WO2005/040598

PCT Pub. Date: May 5, 2006

(65) Prior Publication Data

US 2007/0063159 A1 Mar. 22, 2007

(30) Foreign Application Priority Data

Sep. 26, 2003 (DE) ..... 103 44 897

(51) Int. Cl.
*F02M 59/46* (2006.01)

(52) U.S. Cl. ..... 239/96; 239/533.12; 251/121; 251/282

(58) Field of Classification Search ..... 251/282, 251/120, 121; 239/96, 533.12, 533.7
See application file for complete search history.

(56) References Cited

U.S. PATENT DOCUMENTS 4,653,455 A * 3/1987 Eblen et al. ..... 239/88

(Continued)

FOREIGN PATENT DOCUMENTS

DE 42 36 882 C1 4/1994

(Continued)

*Primary Examiner*—John Bastianelli
(74) *Attorney, Agent, or Firm*—Ronald E. Greigg

(57) ABSTRACT

Disclosed is a valve comprising a valve member (72) that is guided so as to be movable in the direction of the longitudinal axis (73) thereof, extends into a valve pressure chamber (77), and is provided with a sealing surface (81) on a face which runs perpendicular to the longitudinal axis (73) thereof inside the valve pressure chamber (77). Said sealing surface (81) of the valve member (72) cooperates with a valve seat (79) that runs perpendicular to the longitudinal axis (73) thereof so as to at least largely close an opening (78) which is surrounded by the valve seat (79) relative to the valve pressure chamber (77). A connection (64) to a low-pressure area lies immediately next to said opening (78). The inventive valve member (72) is also provided with a peg (83) which extends into the connection (64) and by means of which liquid that flows out of the valve pressure chamber (77) when the sealing surface (81) of the valve member (72) is lifted from the valve seat (79) is directed in such a way that said liquid applies at least nearly no resulting force onto the valve member (72) in the direction of the longitudinal axis (73) thereof.

14 Claims, 4 Drawing Sheets

U.S. PATENT DOCUMENTS

| | | | | |
|---|---|---|---|---|
| 5,004,154 | A * | 4/1991 | Yoshida et al. | 239/96 |
| 5,127,583 | A * | 7/1992 | Taue | 239/96 |
| 6,364,282 | B1 | 4/2002 | Ausman et al. | |
| 2002/0017576 | A1 * | 2/2002 | Boecking | 239/533.11 |
| 2002/0043569 | A1 * | 4/2002 | Boecking | 239/88 |
| 2003/0057298 | A1 * | 3/2003 | Boecking | 239/533.3 |
| 2004/0149838 | A1 | 8/2004 | Potschin et al. | |

FOREIGN PATENT DOCUMENTS

| | | | |
|---|---|---|---|
| EP | 0 840 003 | A1 | 5/1998 |
| JP | 61-72867 | | 4/1986 |
| JP | 5-66374 | | 9/1993 |
| JP | 7-253170 | | 10/1995 |
| WO | WO 03/058052 | A1 | 7/2003 |

* cited by examiner

VALVE FOR CONTROLLING A CONNECTION IN A HIGH-PRESSURE FUEL INJECTION APPARATUS FOR AN INTERNAL COMBUSTION ENGINE

CROSS-REFERENCE TO RELATED APPLICATIONS

This application is a 35 USC 371 application of PCT/DE2004/001744 filed on Aug. 4, 2004.

BACKGROUND OF THE INVENTION

1. Field of the Invention

The present invention is based on a valve for controlling a connection in a high-pressure fluid system, in particular in a fuel injection apparatus for an internal combustion engine.

2. Description of the Prior Art

A valve of the type with which this invention is concerned, known from EP 0 840 003 A, serves to control a connection in a fuel injection apparatus for an internal combustion engine and has a valve member that is guided so that it can slide in the direction of its longitudinal axis, protrudes into a valve pressure chamber, and, in the valve pressure chamber, has a sealing surface at an end extending transversely in relation to its longitudinal axis. The sealing surface of the valve member cooperates with a valve seat extending transversely in relation to its longitudinal axis in order to close an opening encompassed by the valve seat in relation to the pressure chamber. In this case, high pressure prevails in the valve pressure chamber and the opening is adjoined by a duct leading to a low-pressure region; the valve member controls the connection of the valve pressure chamber to the low-pressure region, thus controlling the pressure in the valve pressure chamber. When the valve is open, i.e. when its sealing surface is lifted away from the valve seat, fuel flows out of the valve pressure chamber into the low-pressure region. The outgoing fuel generates forces acting on the valve member in the direction of its longitudinal axis that can cause the valve member to move uncontrollably in the direction of its longitudinal axis. This can make it impossible to precisely control the fuel injection, chiefly the injected fuel quantity, or can even result in a complete functional failure of the valve and therefore of the fuel injection apparatus. In addition, the high flow velocity of the fuel flowing out of the valve pressure chamber into the low-pressure region and the lack of optimal flow guidance in the known valve can lead to cavitation and therefore damage to the valve member and/or the valve seat.

SUMMARY AND ADVANTAGES OF THE INVENTION

The valve according to the present invention has the advantage over the prior art that the operability of the valve is assured since the fuel flowing out of valve pressure chamber subjects the valve member to substantially no forces or only slight ones.

Advantageous embodiments and modifications of the valve according to the present invention are disclosed. One embodiment permits a simple design of the pin for achieving the desired action, while permits an at least approximately cavitation-free fluid flow along the valve member and along the valve seat.

BRIEF DESCRIPTION OF THE DRAWINGS

A number of exemplary embodiments of the present invention are described more fully herein below, with reference to the drawings, in which.

DESCRIPTION OF THE PREFERRED EMBODIMENTS

Figure 1:
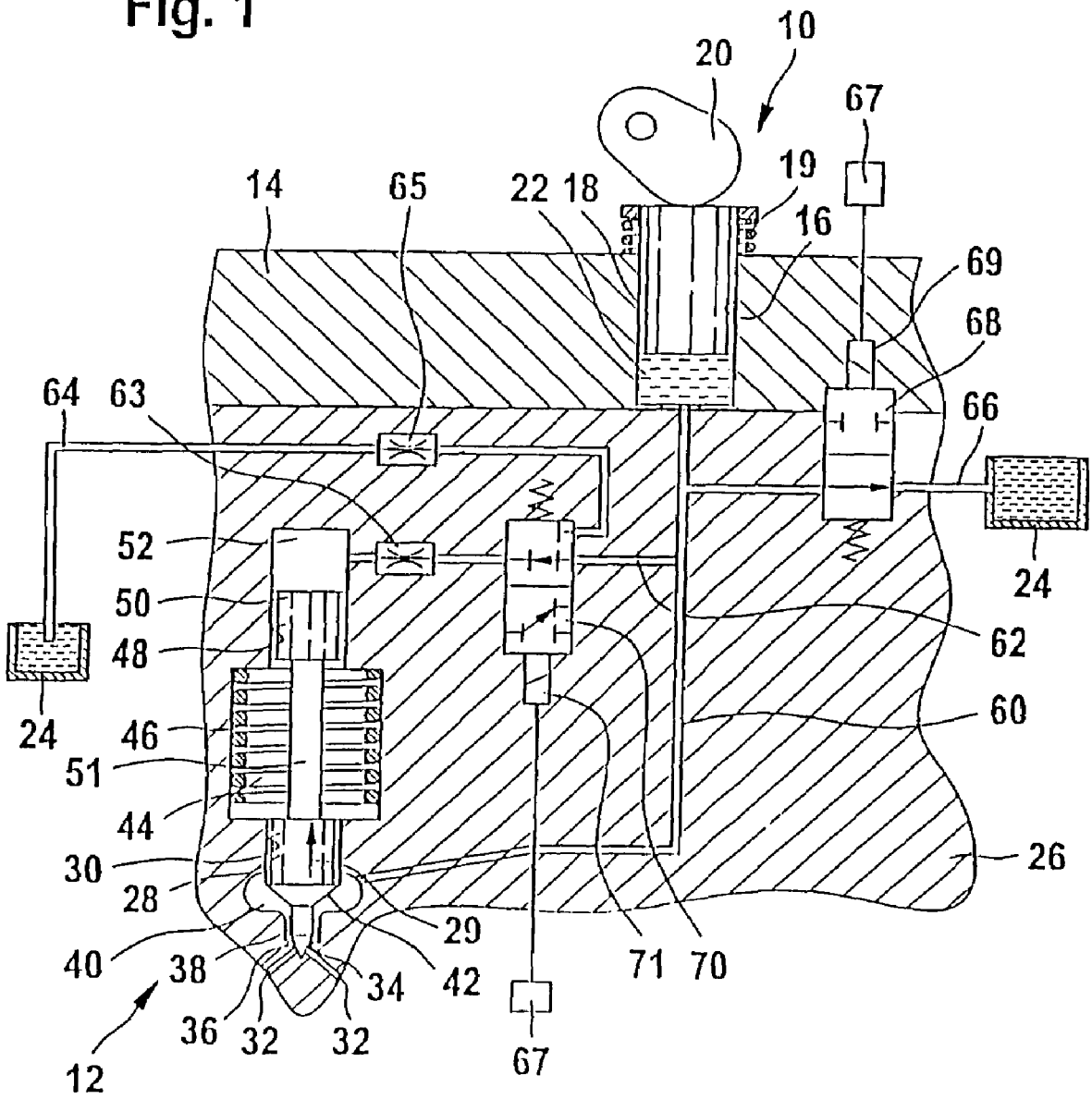
FIG. 1 shows a simplified longitudinal section through a fuel injection apparatus for an internal combustion engine, which is equipped with a valve.

FIG. 1 shows a fuel injection apparatus for an internal combustion engine of a motor vehicle. The internal combustion engine is preferably an autoignition internal combustion engine. The fuel injection apparatus is embodied, for example, in the form of a so-called unit injector and, for each cylinder of the engine, has a respective high-pressure fuel pump 10 and a fuel injection valve 12 connected to it that constitute an integrated structural unit. Alternatively, the fuel injection apparatus can also be embodied in the form of a so-called unit pump system in which the high-pressure fuel pump and the fuel injection valve of each cylinder are separate from each other and are connected to each other via a line. Furthermore, the fuel injection apparatus can also be embodied in the form of an accumulator injection system in which a high-pressure pump delivers fuel into an accumulator that is connected to the at least one injector in which a controlled valve is situated, which is embodied in the form of the valve 70 described below. The valve 70 described below can also be used in an accumulator injection system in which a pressure booster is provided, which is preferably close to the injector or integrated into the injector; the valve 70 is provided to control the pressure booster. The high-pressure fuel pump 10 has a pump body 14 with a cylinder bore 16 in which a pump piston 18 is guided in a sealed fashion and a cam 20 of a camshaft of the internal combustion engine at least indirectly drives this pump piston 18 into a stroke motion counter to the force of a return spring 19. The pump piston 18 delimits a pump working chamber 22 in the cylinder bore 16 in which fuel is compressed at high pressure during the delivery stroke of the pump piston 18. The pump working chamber 22 is supplied with fuel from a fuel tank 24 of the motor vehicle.

Connected to the pump body 14, the fuel injection valve 12 has a valve body 26 that can be comprised of multiple parts, in which an injection valve member 28 is guided so that it can slide longitudinally in a bore 30. The valve body 26 has at least one, preferably several injection openings 32 in its end region oriented toward the combustion chamber of the cylinder of the internal combustion engine. The end region of the injection valve member 28 oriented toward the combustion chamber has a for example approximately conical sealing surface 34, which cooperates with a valve seat 36 that is embodied in the end region of the valve body 26 oriented toward the combustion chamber; the injection openings 32 lead from this valve seat 36 or branch off downstream of it. In the valve body 26, between the injection valve member 28 and the bore 30, toward the valve seat 36, there is an annular chamber 38, which, in its end region oriented away from the valve seat 36, transitions by means of a radial expansion of the bore 30 into a pressure chamber 40 encompassing the injection valve member 28. At the level of the pressure chamber 40, the injection valve member 28 has a pressure shoulder 42 formed by a cross-sectional constriction. A prestressed closing spring 44 engages the end of the injection valve member 28 oriented away from the combustion chamber and presses the injection valve member 28 toward the valve seat 36. The closing spring 44 is situated in a spring chamber 46 of the valve body 26 adjoining the bore 30.

At its end oriented away from the bore 30, the spring chamber 46 is adjoined in the valve body 26 by another bore 48 in which a control piston 50 connected to the injection valve member 28 is guided in a sealed fashion. The bore 48 constitutes a control pressure chamber 52 that is delimited by the control piston 50, which functions as a moving wall. The control piston 50 is supported on the valve member 28 by means of a piston rod 51 that is smaller in diameter than, and can be connected to, the injection valve member 28. The control piston 50 can be embodied of one piece with the injection valve member 28, but for ease of assembly, is preferably embodied as a separate part that is attached to the injection valve member 28.

According to FIG. 1, a duct 60 leads from the pump working chamber 22 through the pump body 14 and the valve body 26 to the pressure chamber 40 of the fuel injection valve 12. A duct 62 leads from the duct 60 or the pump working chamber 22 to the control pressure chamber 52. The control pressure chamber 52 can also be connected to a duct 64 that constitutes a connection to a discharge chamber, which function can be fulfilled at least indirectly by the fuel tank 24 or another region in which a low pressure prevails. A connection 66 controlled by a first electrically actuated control valve 68 leads from the duct 60 or the pump working chamber 22 to a discharge chamber. The fuel tank 24 or another low-pressure region can at least indirectly serve as the discharge chamber. The control valve 68 can be embodied in the form of a 2/2-way valve, as depicted in FIG. 1. An actuator 69 that can, for example, be an electromagnet switches the control valve 68 between its two switched positions, counter to the force of a return spring.

A second electrically actuated control valve 70 is provided to control the pressure in the control pressure chamber 52. The second control valve 70 is embodied in the form of a 3/2-way valve that can be switched between two switched positions. In a first switched position, the control valve 70 connects the control pressure chamber 52 to the pump working chamber 22 and disconnects it from the discharge chamber 24; in a second switched position, the control valve 70 disconnects the control pressure chamber 52 from the pump working chamber 22 and connects it to the discharge chamber 24. The connection 62 of the control pressure chamber 52 to the pump working chamber 22 contains a throttle restriction 63, and the connection 64 of the control pressure chamber 52 to the discharge chamber 24 contains a throttle restriction 65. The throttle restriction 63 can be situated in the connection 62 upstream of the control valve 70 or, as shown in FIG. 1, can be situated in the connection 62 downstream of the control valve 70. The control valve 70 has an actuator 71 that can be an electromagnet, a piezoelectric actuator, or a magnetostrictive actuator and can switch the control valve 70 between its two switched positions counter to the force of a return spring. An electronic control unit 67 triggers the two control valves 68, 70.

The second control valve 70 will be explained in greater detail below in conjunction with FIG. 2. The control valve 70 has a valve member 72 that is guided by means of a shaft 74 so that it can slide in the direction of its longitudinal axis 73 and, with an end region 75 whose diameter is enlarged in relation to the shaft 74, protrudes into a valve pressure chamber 77. On the one hand, the connection 62 to the pump working chamber 22 feeds into the valve pressure chamber 77 and on the other hand, the connection 64 to the discharge chamber 24 feeds from it. The connection 62 in this case extends in the form of annular gap between the shaft 74 and a bore 76 encompassing it. The bore 76 is smaller in diameter than the valve pressure chamber 77. The connection 64, which is embodied in the form of a duct or a bore, connects to the valve pressure chamber 77 by means of an opening 78 that is encompassed by a surface 79, which constitutes a valve seat and extends transversely, preferably at least approximately perpendicularly, in relation to the longitudinal axis 73 of the valve member 72. Toward the valve seat 79, the valve member 72 has an at least approximately cylindrical extension 80 whose end surface constitutes a sealing surface 81 that extends transversely, preferably at least approximately perpendicularly, in relation to the longitudinal axis 73 of the valve member 72. The extension 80 has a smaller diameter than the end region 75 of the valve member 72, but the diameter of the extension 80 is greater than that of the opening 78.

Figure 2:
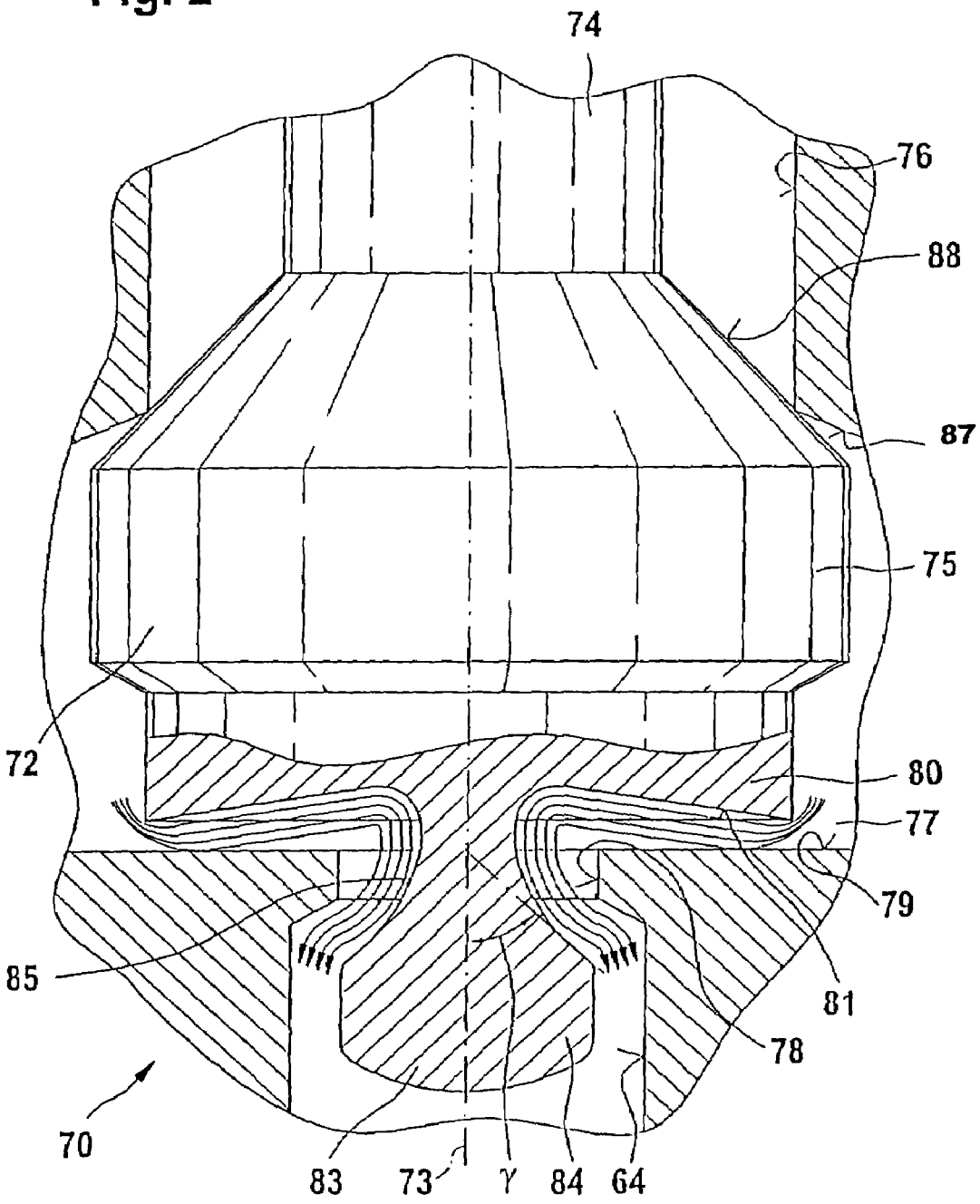
FIG. 2 shows an enlarged longitudinal section through the valve according to a first exemplary embodiment of the invention.

As depicted in FIG. 2, from the outer edge of the valve member 72, the sealing surface 81 is inclined as it extends radially inward so that the distance between it and the valve seat 79 increases in the direction of the longitudinal axis 73 of the valve member 72. This provides the outer edge of the sealing surface 81 with a narrow sealing edge with which the sealing surface 81 contacts the valve seat 79. The valve member 72 has a pin 83, which protrudes into the bore 64 adjoining the opening 78 and is preferably integrally formed onto the valve member 72. As shown in FIG. 2, the diameter of the bore 64 can be enlarged after the opening 78. The pin 83 is embodied such that when the control valve 70 is open, the pin deflects fuel flowing out of the valve pressure chamber 77 in such a way that this outgoing fuel exerts at least essentially no resulting force or only a slight resulting force on the valve member 72 in the direction of the longitudinal axis 73. The pin 83 extends in the direction of the longitudinal axis 73 of the valve member 72 until the level of its sealing surface 81. The transition from the inner edge of the sealing surface 81 to the pin 83 extends in a rounded fashion, as shown in FIG. 2. The fuel that initially flows out of the valve pressure chamber 77 along the sealing surface 81 in an approximately radial inward direction is consequently deflected by the pin 83 in such a way that it then flows into the bore 64 approximately in the direction of the longitudinal axis 73 of the valve member 72. The pin 83 consequently initially deflects the fuel flow by approximately 90°. At its end protruding into the bore 64, the pin 83 has an enlarged part 84 so that the fuel flow is deflected again there; this enlarged part 84 extends away from the valve member 72 at an angle $\gamma$ in relation to the longitudinal axis 73 of the valve member 72. The angle $\gamma$ can be between greater than 0° and approximately 90° or can also be greater than 90°. Between its enlarged part 84 and the sealing surface 81, the pin 83 can have a circumferential annular groove 85 whose side surfaces pointing in the direction of the longitudinal axis 73 of the valve member 72 deflect the fuel flow. Due to the multiple deflection of the fuel flow along the side surfaces of the annular groove 85, the forces that the deflection produces on the valve member 72 in the direction of its longitudinal axis 73 at least approximately balance out so that on the whole, the fuel flow exerts at least approximately no force or only a slight force on the valve member 72 in the direction of the longitudinal axis 73. The transitions from the side surfaces of the annular groove 85 to the bottom of the annular groove 85 and to the circumference of the pin 83 are each rounded in order to minimize flow losses.

The transition from the bore 76 into the valve pressure chamber 77 is provided with a conical transition surface 87 that constitutes a second valve seat. At the transition from the end region 75 to the shaft 74, the valve member 72 is provided with a second, conical sealing surface 88 that cooperates with the valve seat 87 to control the connection 62. In the second switched position of the control valve 70, the second sealing surface 88 of the valve member 72 rests against the second sealing seat 87, thus closing the connection 62 to the pump working chamber 22. In the first switched position of the control valve 70, the sealing surface 88 of the valve member 72 is spaced apart from the second valve seat 87, thus opening the connection 62 to the pump working chamber 22. In the first switched position of the control valve 70, the sealing surface 81 of the valve member 72 rests against the valve seat 79.

It is also possible for the actuator 71 to move the valve member 72 into a third switched position in which it is placed between its two switched positions explained above. The valve member 72 thus permits the valve pressure chamber 77 to be connected to the low-pressure region with a low flow cross section via which fuel is only able to flow out of the valve pressure chamber 77 in a throttled fashion. When the valve member 72 is in its third switched position, the pressure buildup in the control pressure chamber 52 is influenced in such a way that a higher pressure prevails in the control pressure chamber 52 than when the valve member 72 is in its first switched position, but a lower pressure prevails than when the valve member 72 is in its second switched position. The control valve 70 here is embodied in the form of a 3/3-way valve.

Figure 3:
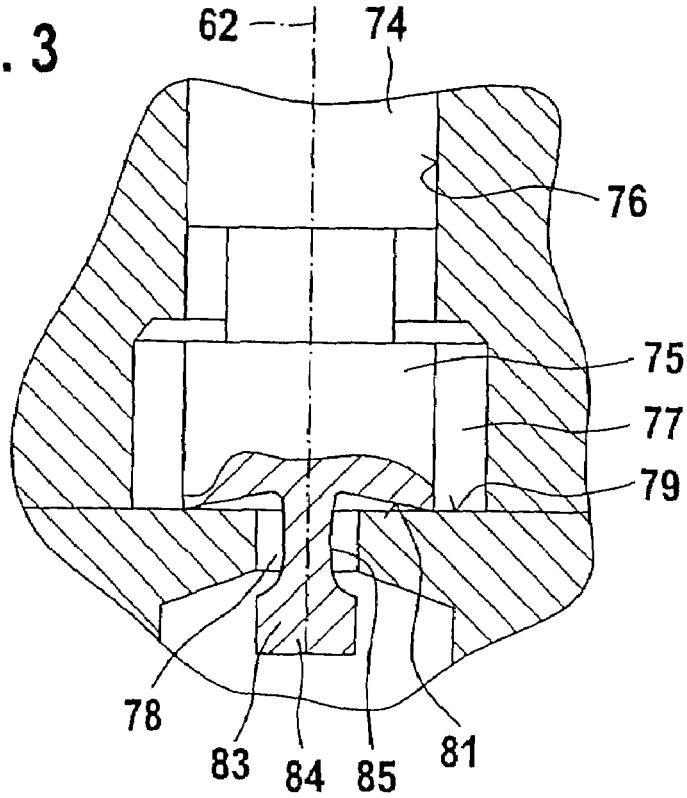
FIG. 3 shows an embodiment of the valve that is modified in relation to the first exemplary embodiment.

FIG. 3 shows a modified embodiment of the control valve 70 in which the conical valve seat 81 and the conical sealing surface 88 of the valve member 72 have been omitted. Instead, the valve member 72 is embodied in the form of a slide valve member for controlling the connection 62. In order to close the connection 62, the end region 75 of the valve member 72 here can plunge into the bore 76 in a sealed fashion. If the end region 75 of the valve member 72 has left the bore 76 and is positioned in the valve pressure chamber 77, then the connection 62 is open.

Figure 4:
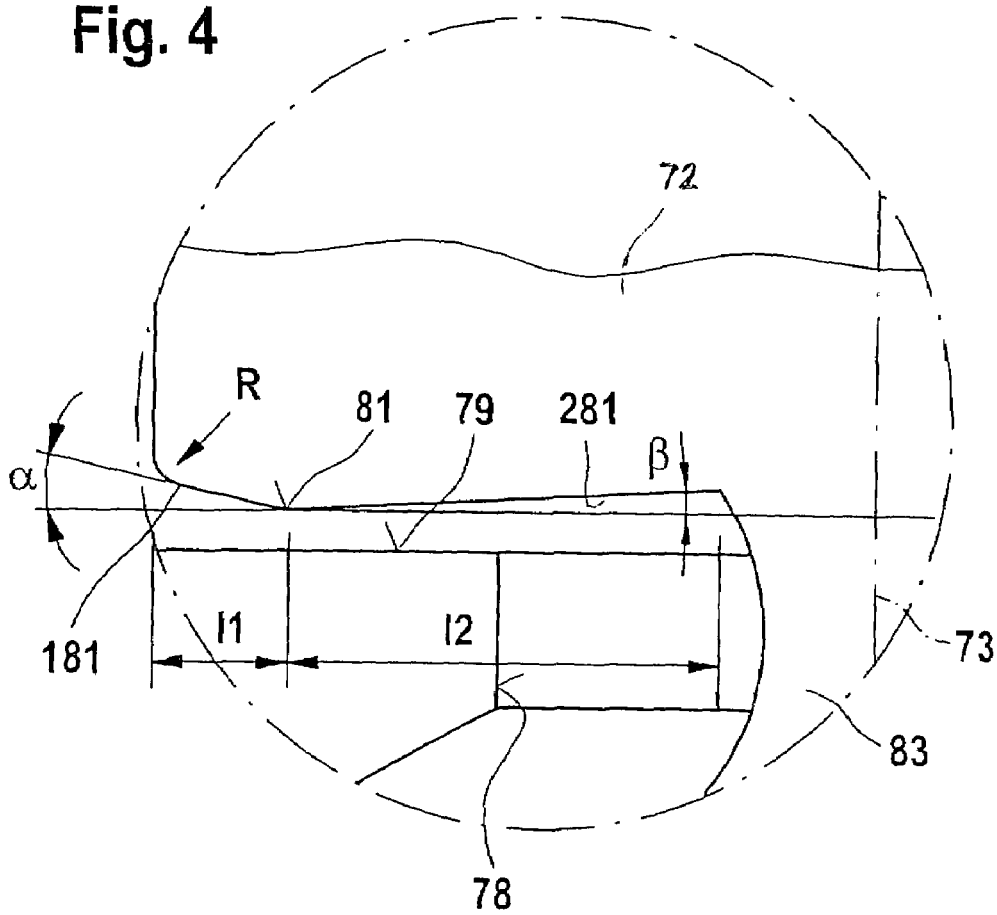
FIG. 4 shows a longitudinal section through the valve according to a second exemplary embodiment.

FIG. 4 shows the control valve 70 according to a second exemplary embodiment in which the design is essentially the same as in the first exemplary embodiment, but the design of the sealing surface 81 has been modified. The pin 83 of the valve member 72 is embodied in the same form as in the first exemplary embodiment. The sealing surface 81 is embodied so that in an outer region 181 starting from its outer edge, the sealing surface 81 approaches the valve seat 79 as it extends radially inward. The region 181 of the sealing surface 81 here is inclined at an angle $\alpha$ that is preferably at least approximately 5° in relation to a radial plane of the longitudinal axis 73 of the valve member 72. The region 181 of the sealing surface 81 has a radial span 11 that is preferably approximately 0.3 mm when a diameter of the valve member 72 is approximately 2.5 mm. In a second region 281 adjoining the first region 181, the sealing surface 81 is embodied so that it recedes from the valve seat 79 as it extends radially inward. The second region 281 of the sealing surface 81 is inclined at an angle $\beta$, which is preferably at least approximately 2°, in relation to the radial plane. The second region 281 of the sealing surface 81 has a radial span 12 that is preferably approximately 0.6 mm. This embodiment of the sealing surface 81 provides it with a flow inlet region in its first region 181—in which the fuel flowing out of the valve pressure chamber 77 is conveyed into the smallest flow cross section between the sealing surface 81 and the valve seat 79—and provides it with a flow outlet region in its second region 281—in which the fuel is conveyed out of the smallest flow cross section. As in the first exemplary embodiment, the valve seat 79 is embodied as at least approximately planar and lies in a radial plane in relation to the longitudinal axis 73 of the valve member 72. The transition from the outer circumference of the extension 80 of the valve member 72 to the first region 181 of the sealing surface 81 is preferably rounded with a radius R, as shown in FIG. 4.

Figure 5:
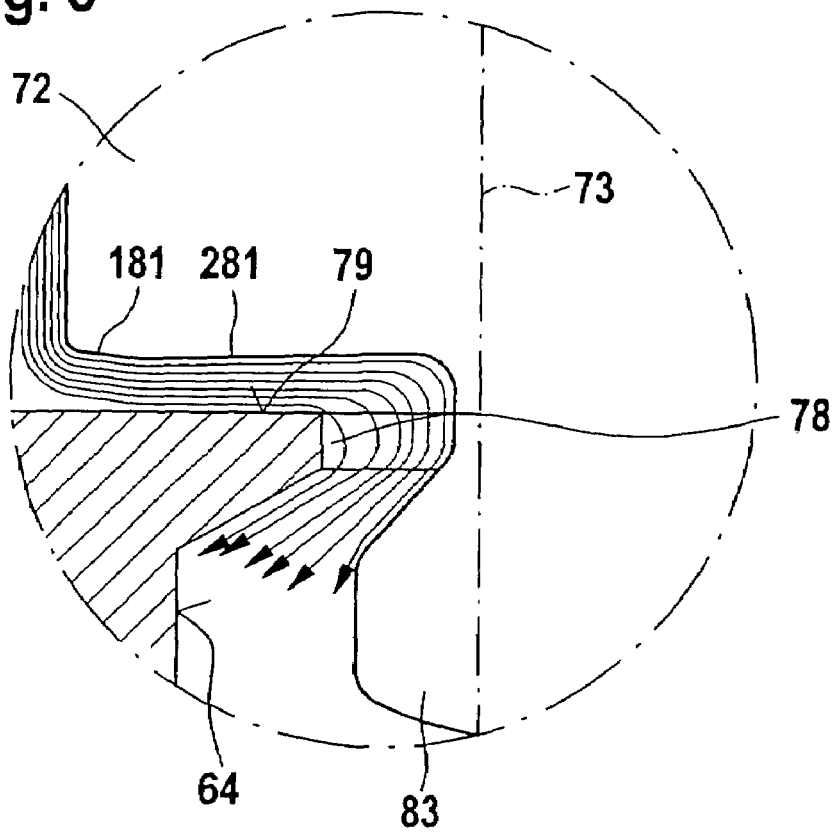
FIG. 5 shows the valve according to the second exemplary embodiment, with a fluid flow.

FIG. 5 shows the improved flow path with the valve member 72 according to the second exemplary embodiment. Whereas with the use of the valve member 72 according to the first exemplary embodiment, flow separations occur at the entry of the flow into the narrowest flow cross section between the sealing surface 81 and the valve seat 79, with the use of the valve member 72 according to the second exemplary embodiment, these flow separations either do not occur at all or at least occur only to a limited degree. This reduces flow losses and achieves a cavitation-free flow.

Figure 6:
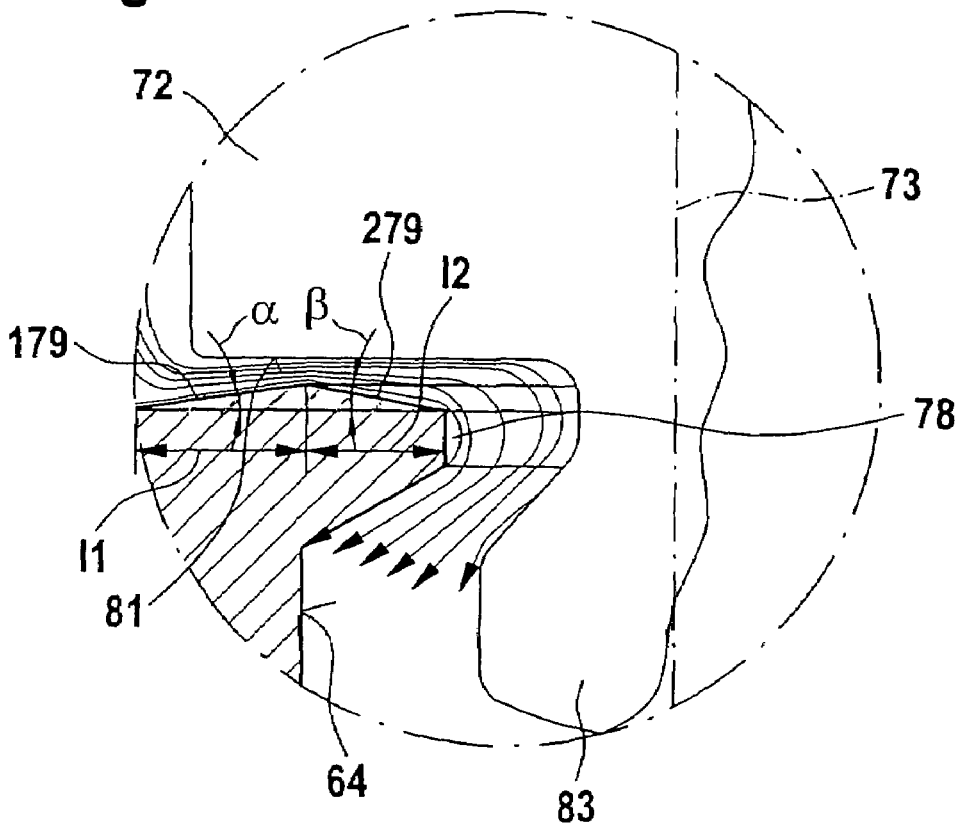
FIG. 6 shows an embodiment of the valve that is modified in relation to the second exemplary embodiment.

FIG. 6 shows the control valve 70 according to an embodiment that has been modified in relation to the second exemplary embodiment. In this case, the sealing surface 81 on the valve member is embodied as at least approximately planar and lies in a radial plane in relation to the longitudinal axis 73 of the valve member 72. The valve seat 79 is embodied in such a way that in an outer region 179 starting from its outer edge, the valve seat 79 approaches the sealing surface 81 as it extends radially inward. The region 179 of the valve seat 79 is inclined at an angle $\alpha$, which is preferably at least approximately 5°, in relation to a radial plane of the longitudinal axis 73 of the valve member 72. Starting from the outer edge of the sealing surface 81 of the valve member, the region 179 of the valve seat 79 has a radial span 11 that is preferably approximately 0.3 mm when a diameter d of the valve member 72 is approximately 2.5 mm. In a second region 279 adjoining the first region 179, the valve seat 79 is embodied so that it recedes from the sealing surface 81 as it extends radially inward. The second region 279 of the valve seat 79 is inclined at an angle $\beta$, which is preferably at least approximately 2°, in relation to the radial plane. The second region 279 of the valve seat 79 has a radial span 12 that is preferably approximately 0.6 mm. This design, which is the reverse of the second exemplary embodiment, achieves the same advantages with regard to an optimized flow guidance as the second exemplary embodiment The function of the fuel injection apparatus will be explained below. During the intake stroke of the pump piston 18, it is supplied with fuel from the fuel tank 24. During the delivery stroke of the pump piston 18, the fuel injection begins with a preinjection in which the control unit 67 closes the first control valve 68 so that the pump working chamber 22 is disconnected from the discharge chamber 24. The control unit 67 also brings a second control valve 70 into its second switched position so that the control pressure chamber 52 is connected to the discharge chamber 24 and disconnected from the pump working chamber 22. In this case, high pressure is unable to build up in the control pressure chamber 52.

If the pressure in the pump working chamber 22 and therefore in the pressure chamber 40 of the fuel injection valve 12 is so great that the compressive force it exerts on the injection valve member 28 by means of the pressure shoulder 42 is greater than the sum of the force of the closing spring 44 and the compressive force that the residual pressure in the control pressure chamber 52 exerts on the control piston 50, then the injection valve member 28 moves in the opening direction 29, thus unblocking the at least one injection opening 32.

In order to terminate the preinjection occurring in this manner, the control unit brings the second control valve 70 into its first switched position so that the control pressure chamber 52 is disconnected from the discharge chamber 24 and connected to the pump working chamber 22. The first control valve 68 remains in its closed position. As a result, high pressure builds up in the control pressure chamber 52 and in the pump working chamber 22 so that a powerful compressive force acts on the control piston 50 in the closing direction and the injection valve member 28 is moved into its closed position.

For a subsequent main injection, the control unit 67 brings the second control valve 70 into its second switched position so that the control pressure chamber 52 is connected to the discharge chamber 24 and disconnected from the pump working chamber 22. The fuel injection valve 12 then opens as a result of the reduced compressive force acting on the control piston 50 and the injection valve member 28 moves into its open position.

In order to terminate the main injection, the control unit 67 brings the second control valve 70 into its first switched position so that the control pressure chamber 52 is disconnected from the discharge chamber 24 and connected to the pump working chamber 22; as a result, high pressure builds up in the control pressure chamber 52 and the force exerted on the control piston 50 closes the fuel injection valve 12. After the main injection, a secondary injection can also be executed for which the second control valve 70 is brought into its second switched position. In order to terminate the secondary injection, the second control valve 70 is brought back into its first switched position and/or the first control valve 68 is opened.

A control valve 70 embodied in the manner described above can also be used to control a connection in other fuel injection apparatuses or high pressure fluid systems. The control valve 70 can also be embodied in the form of a 2/2-way valve, a 2/3-way valve, or a 3/3-way valve.

The foregoing relates to preferred exemplary embodiments of the invention, it being understood that other variants and embodiments thereof are possible within the spirit and scope of the invention, the latter being defined by the appended claims.

The invention claimed is:

1. A valve for controlling a connection in a high-pressure fluid system, in a fuel injection apparatus for an internal combustion engine, the valve having a valve member guided for sliding movement in the direction of a longitudinal axis of the valve member and protruding into a valve pressure chamber in which high pressure prevails at least some of the time, a sealing surface on the valve member in the valve pressure chamber at an end extending transversely in relation to the longitudinal axis of the valve member, the sealing surface of the valve member cooperating with a valve seat in the valve pressure chamber and extending transversely in relation to the longitudinal axis of the valve member in order, at least to a large extent, to close an opening encompassed by the valve seat in relation to the valve pressure chamber which opening is adjoined by a connection leading to a low-pressure region, and a pin on the valve member, the pin protruding into the connection and, when the sealing surface of the valve member is lifted away from the valve seat, this pin conveys fluid flowing out of the valve pressure chamber in such a way that the outgoing fluid exerts at least approximately no resulting force or only a slight resulting force on the valve member in the direction of the longitudinal axis, wherein the valve seat and/or the sealing surface on the valve member is embodied so that the distance between the sealing surface and the valve seat, starting from an outer edge of the valve member, first decreases as it extends radially inward toward the longitudinal axis of the valve member and then increases again as it continues to extend radially inward, as one of the valve seat or the sealing surface on the valve member is embodied by two regions that are inclined contrary to one another and adjoin one another directly, and the other of the valve seat or the sealing surface is embodied as a plane and is disposed at least approximately perpendicular to the longitudinal axis of the valve member.

2. The valve according to claim 1, wherein the pin initially deflects fluid flowing out of the valve pressure chamber in such a way that the fluid flows along the valve member into the connection at least approximately in the direction of the longitudinal axis of the valve member.

3. The valve according to claim 2, wherein the pin then deflects the outgoing fluid so that it flows away from the longitudinal axis of the valve member at an angle $\gamma$ in relation to this longitudinal axis.

4. The valve according to claim 1, wherein the pin has a circumferential annular groove for flow deflection, which groove extends in the direction of the longitudinal axis of the valve member, at least approximately to the level of the sealing surface of the valve member.

5. The valve according to claim 2, wherein the pin has a circumferential annular groove for flow deflection, which groove extends in the direction of the longitudinal axis of the valve member, at least approximately to the level of the sealing surface of the valve member.

6. The valve according to claim 3, wherein the pin has a circumferential annular groove for flow deflection, which groove extends in the direction of the longitudinal axis of the valve member, at least approximately to the level of the sealing surface of the valve member.

7. The valve according to claim 1, wherein the sealing surface of the valve member is embodied as at least approximately planar.

8. The valve according to claim 2, wherein the sealing surface of the valve member is embodied as at least approximately planar.

9. The valve according to claim 3,wherein the sealing surface of the valve member is embodied as at least approximately planar.

10. The valve according to claim 4,wherein the sealing surface of the valve member is embodied as at least approximately planar.

11. The valve according to claim 1, wherein the valve seat is embodied as at least approximately planar.

12. The valve according to claim 2, wherein the valve seat is embodied as at least approximately planar.

13. The valve according to claim 3, wherein the valve seat is embodied as at least approximately planar.

14. The valve according to claim 4, wherein the valve seat is embodied as at least approximately planar.

* * * * *